US009457227B2

(12) United States Patent
Hetzel

(10) Patent No.: US 9,457,227 B2
(45) Date of Patent: Oct. 4, 2016

(54) ADJUSTABLE PUSH-UP APPARATUS

(71) Applicant: John Hetzel, Fairview Heights, IL (US)

(72) Inventor: John Hetzel, Fairview Heights, IL (US)

( * ) Notice: Subject to any disclaimer, the term of this patent is extended or adjusted under 35 U.S.C. 154(b) by 0 days.

(21) Appl. No.: 14/641,965

(22) Filed: Mar. 9, 2015

(65) Prior Publication Data

US 2015/0258364 A1 Sep. 17, 2015

Related U.S. Application Data

(60) Provisional application No. 61/951,602, filed on Mar. 12, 2014.

(51) Int. Cl.

| | |
|---|---|
| ***A63B 71/00*** | (2006.01) |
| ***A63B 23/035*** | (2006.01) |
| ***A63B 23/12*** | (2006.01) |
| ***A63B 21/00*** | (2006.01) |

(52) U.S. Cl.

CPC ..... *A63B 23/0355* (2013.01); *A63B 21/00047* (2013.01); *A63B 21/00072* (2013.01); *A63B 21/4035* (2015.10); *A63B 23/1236* (2013.01); *A63B 2225/055* (2013.01); *A63B 2225/093* (2013.01)

(58) Field of Classification Search

CPC ..... A63B 21/00047; A63B 21/00058; A63B 21/00069; A63B 21/00072; A63B 21/00185; A63B 21/012; A63B 21/0125; A63B 21/015; A63B 21/04; A63B 21/0407; A63B 21/0414; A63B 21/0421; A63B 21/0428; A63B 21/0435; A63B 21/0442; A63B 21/05; A63B 21/062; A63B 21/0624; A63B 21/0626; A63B 21/068; A63B 21/078; A63B 21/08; A63B 21/15; A63B 21/159; A63B 21/16; A63B 21/1609; A63B 21/1618; A63B 21/1645; A63B 21/1654; A63B 21/1681; A63B 21/169; A63B 21/22; A63B 21/4023; A63B 21/4027; A63B 21/4033; A63B 21/4035; A63B 21/4039; A63B 21/4045; A63B 21/4047; A63B 21/4049; A63B 23/12; A63B 23/1209; A63B 23/1236; A63B 23/1245; A63B 23/1281; A63B 2071/009; A63B 2208/0295; A63B 2210/50; A63B 2225/05; A63B 2225/055; A63B 2225/09; A63B 2225/093; Y10T 403/7073; Y10T 403/7077; Y10T 403/32467; Y10T 403/32475; Y10T 403/592

See application file for complete search history.

(56) References Cited

U.S. PATENT DOCUMENTS

| | | | | |
|---|---|---|---|---|
| 2,255,695 | A * | 9/1941 | Bull | E21B 17/046 294/82.28 |
| 2,476,258 | A | 7/1949 | Lundquist | |
| 2,515,493 | A * | 7/1950 | Buono | A45B 19/04 135/75 |
| 2,932,510 | A * | 4/1960 | Kravitz | A63B 3/00 248/423 |
| D260,639 | S * | 9/1981 | Long | D14/224 |
| 4,854,642 | A * | 8/1989 | Vidwans | B60N 2/4817 297/391 |
| 5,205,802 | A * | 4/1993 | Swisher | A63B 21/00047 482/100 |

(Continued)

*Primary Examiner* — Oren Ginsberg
*Assistant Examiner* — Gary D Urbiel Goldner
(74) *Attorney, Agent, or Firm* — Woodard, Emhardt, Moriarty, McNett & Henry LLP

(57) ABSTRACT

Adjustable exercise apparatus described herein include a height-adjustable handle engageable with a base structure having an internal locking mechanism. The apparatus may include interchangeable handles of varying shapes. The base may include legs and/or surface-engaging feet which can provide additional stability or additional configurations. The internal mechanism selectively locks the handle into position at different pre-defined heights and, in some forms, includes a particular bearing arrangement including a push button release and spring closing.

15 Claims, 6 Drawing Sheets

(56) References Cited

U.S. PATENT DOCUMENTS 5,377,943 A 1/1995 Perl
D368,288 S * 3/1996 Kasbohm ..... D21/686
5,527,242 A 6/1996 Gangloff
5,582,565 A 12/1996 Soria
5,697,875 A 12/1997 Stan
5,755,646 A * 5/1998 Chu ..... A63B 21/4001 482/115
5,957,634 A * 9/1999 Carpinetti ..... B23B 31/1071 279/143
6,116,555 A * 9/2000 Claus ..... A47C 3/30 248/161
6,129,651 A * 10/2000 Denaro ..... A63B 21/00047 482/141
7,156,788 B1 1/2007 Jackson et al.
7,367,928 B2 5/2008 Storch
7,621,860 B2 11/2009 Burrell
7,637,851 B1 12/2009 Lormil
7,896,789 B2 3/2011 Hinton et al.
9,242,422 B2 * 1/2016 Schweizer ..... B23B 31/1071
2006/0040809 A1 * 2/2006 Godbold ..... A63B 26/003 482/141
2007/0131070 A1 * 6/2007 Hull ..... B25B 13/461 81/489
2007/0184950 A1 8/2007 Bradley
2012/0004082 A1 1/2012 Senegal
2012/0231937 A1 * 9/2012 Murphy ..... A63B 23/1218 482/93
2012/0319399 A1 * 12/2012 Schweizer ..... B23B 31/1071 285/313
2013/0072365 A1 * 3/2013 Ross ..... A63B 21/1469 482/141
2014/0057764 A1 * 2/2014 Klukas ..... A63B 15/00 482/109
2014/0135189 A1 * 5/2014 Thomason ..... A63B 23/1236 482/141
2015/0111705 A1 * 4/2015 Walker ..... A63B 26/00 482/66
2015/0233522 A1 * 8/2015 Kallas ..... F16M 11/2021 248/170
2015/0246261 A1 * 9/2015 Chen ..... A63B 21/068 482/141

* cited by examiner

ADJUSTABLE PUSH-UP APPARATUS

CROSS-REFERENCE TO RELATED APPLICATIONS

This application claims the benefit of provisional application Ser. No. U.S. 61/951,602, filed on Mar. 12, 2014.

FIELD OF THE DISCLOSURE

The present disclosure relates generally to the field of exercise devices, and more specifically provides a height-adjustable push-up apparatus.

BACKGROUND OF THE DISCLOSURE

Exercising is a popular activity and performing push-ups, in particular, is a desirable and effective way to increase upper body and core strength. Traditionally, push-ups are performed on a stationary ground surface or other horizontal surface. Performing push-ups in the conventional manner can have disadvantages, including lack of variability in performing the exercise and causing stresses and strains to one's body. Some prior art devices have been developed to aid in particular aspects of the push-up exercise. However, many of these devices are limited in adjustability, do not allow for modifications, do not increase comfort, do not relieve stresses and strains, do not allow for ease of storage and transport, are unstable and/or are unable to be sufficiently secured following adjustment. The present disclosure is directed to addressing these limitations and others.

SUMMARY OF THE DISCLOSURE

In certain embodiments, the present disclosure provides a height-adjustable push-up apparatus. The apparatus includes a handle engageable with a stationary base structure at different pre-defined heights. The apparatus may optionally include a set of interchangeable handles in different shapes. In certain aspects, the base structure includes four legs with suction cups which can engage a support surface. Internal to the base structure is a mechanism to selectively lock the handle to the base structure at different selected handle heights. In one specific embodiment, the base structure includes a push button system designed to engage an internal ball bearing mechanism which locks the components together.

Embodiments also include an adjustable locking device, including a stem slideably received in an inner tube, an outer tube, and a latch member extendable toward the stem to fix the position of the stem in the locked position. When in the open position, the inner tube and outer tube are aligned to permit retraction of the latch member and allow the stem to slide to different height positions as desired. A spring or other elastic member may bias the device into the locked position while a button can be provided to disengage the locking mechanism.

Other objects and advantages will be appreciated by reference to the following detailed description when considered in connection with the accompanying drawings.

DESCRIPTION OF THE ILLUSTRATED EMBODIMENTS

For the purposes of promoting an understanding of the principles of the disclosure, reference will now be made to the embodiments illustrated and specific language will be used to describe the same. It will nevertheless be understood that no limitation of the scope of the disclosure is thereby intended, such alterations, modifications, and further applications of the principles of the disclosure being contemplated as would normally occur to one skilled in the art to which the disclosure relates.

Figure 1:
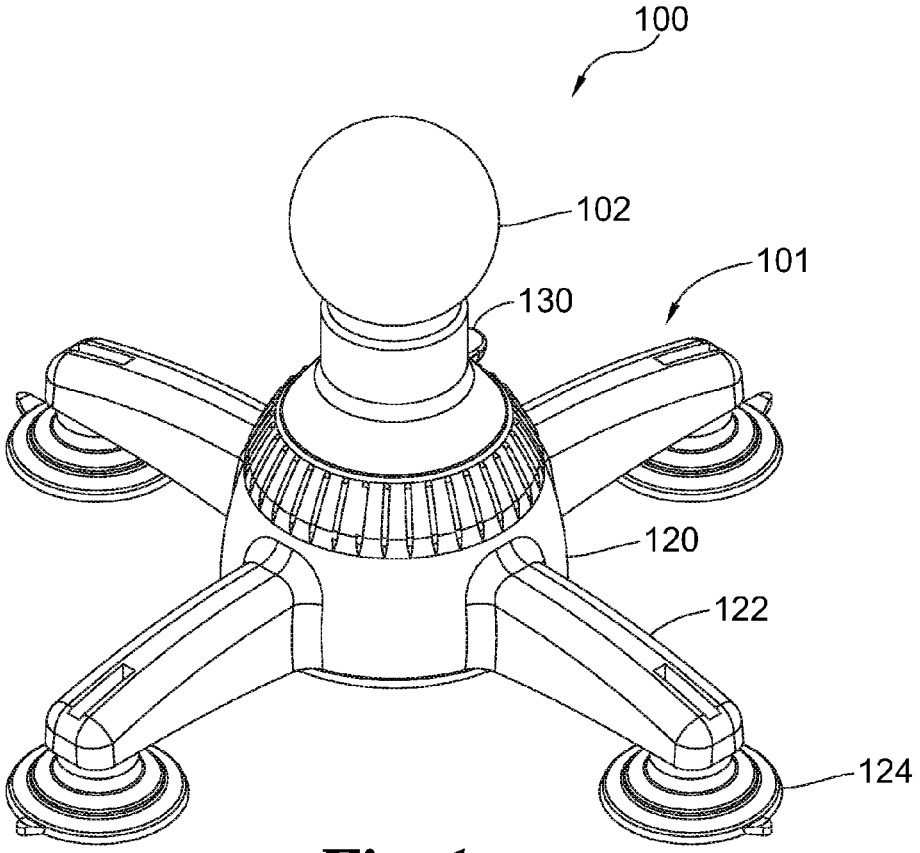
FIG. 1 is a perspective view of an adjustable push-up apparatus according to an embodiment of the present disclosure.
Figure 2:
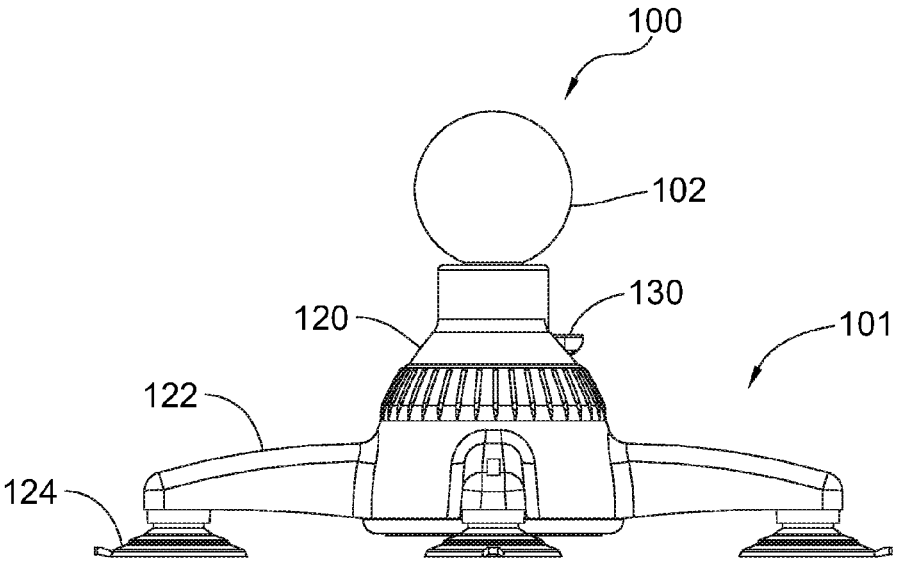
FIG. 2 is a side view of the adjustable push-up apparatus of FIG. 1.
Figure 3:
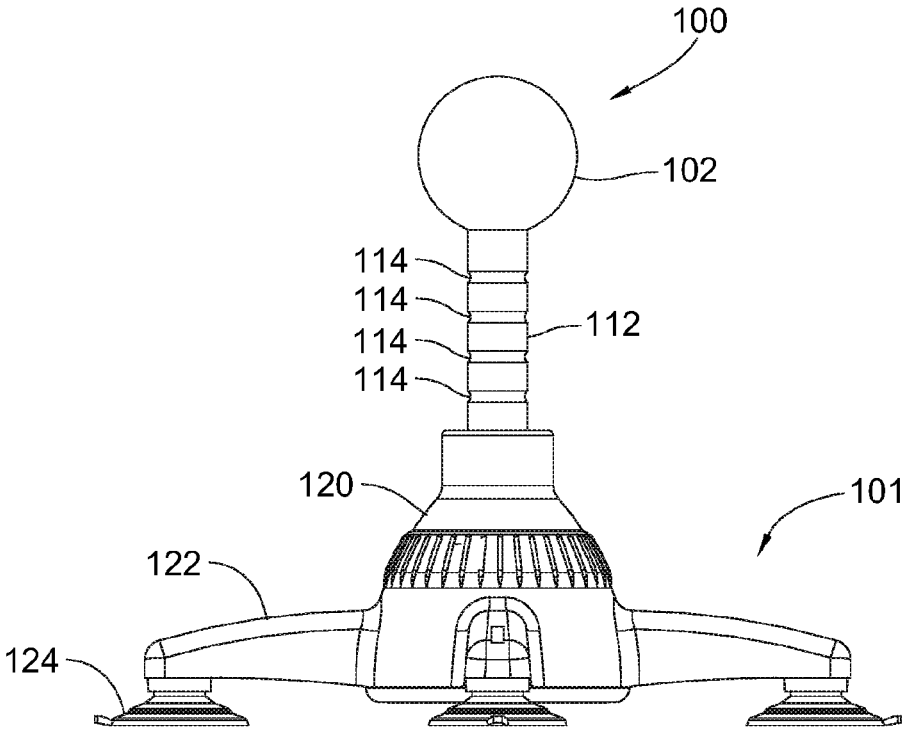
FIG. 3 is another side view of the adjustable push-up apparatus of FIG. 1.
Figure 4A:
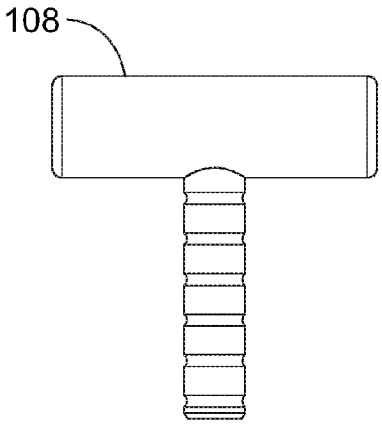
FIGS. 4A-4F include a series of views of optional additional handles.
Figure 4B:
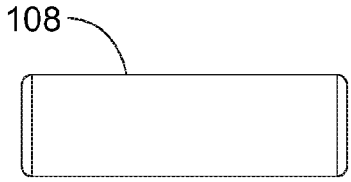
Figure 4C:
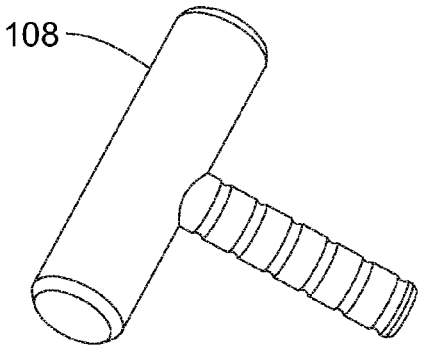
Figure 4D:
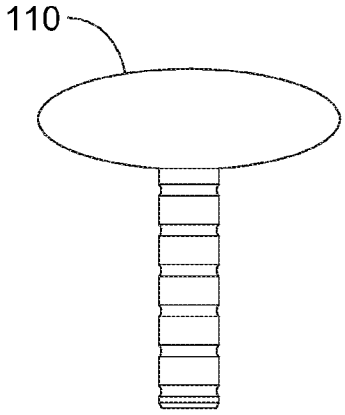
Figure 4E:
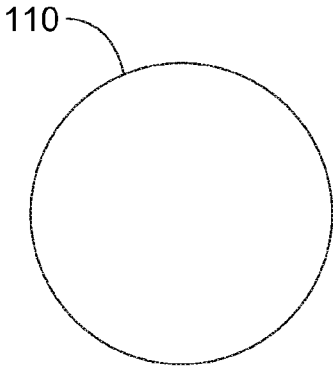
Figure 4F:
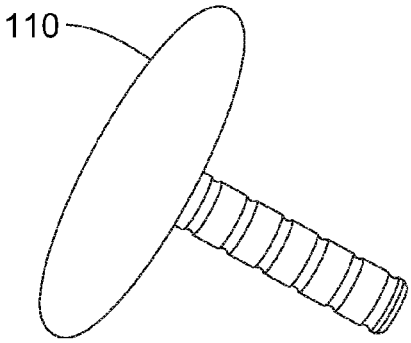

Illustrated in the figures are various views of an adjustable push-up apparatus 100 (and specific example components thereof) according to an embodiment of the present disclosure. FIGS. 1 and 2 show apparatus 100 in the locked and usable position, and at the lowest height adjustment. FIG. 3 shows apparatus 100 in the locked and usable position, and at the highest height adjustment. FIGS. 4A-4F shows a set of interchangeable handles with stems which may optionally be engaged with the base structure of the apparatus 100. FIGS. 5-10 show the internal workings of apparatus 100 at various heights, and at locked and unlocked positions.

Turning to FIGS. 1 and 2, there is shown a handle 102 engaged with a base structure 101 at the lowest height adjustment position. The illustrated base structure 101 includes a central hub 120 covering the internal workings of the base structure and legs 122 to engage a support surface. Legs 122 may extend in lateral or horizontal directions outward from the central hub 120. Legs 122 may be in fixed positions relative to the base structure or optionally, may pivot to provide differing orientations relative to the base structure or relative to the ground or other support surface. The base structure 101 also includes a push button release 130 designed to engage an internal mechanism to lock and unlock the handle 102 with respect to the base structure 101 and allow for height adjustment. Optionally, the legs 122 may include surface-engaging elements, such as the illustrated suction cups 124. The suction cups 124 may optionally be pivotably engaged with the legs 122 via rivets 154 (as seen, for example, in FIG. 5). Additional options for surface-engaging elements include adhesives; pads which may include a gripping material; mechanical fasteners such as screws, nails, or other components that project into the supporting surface; or brackets or hooks designed to engage mounting equipment included in the supporting surface. It should be appreciated that the legs and any surface-engaging elements may number greater or fewer than four and may be symmetrically or asymmetrically arranged around the base structure, as would occur to one of ordinary skill in the art.

In certain optional embodiments, there may be additional handles which can be selectively engaged with the base structure 101. The illustrated handle 102 is a ball handle that is approximately spherical. As shown in FIGS. 4A-4F, other optional selectively-engageable handles include a rectangular or cylindrical hammer-shaped handle 108 (in FIGS. 4A-4C) and a larger circular flatter handle 110 approximating an oblate spheroid (FIGS. 4D-4F), each with its own stem portion. It is contemplated that other shaped handles may be used, with only certain example shapes being illustrated.

Variations in size, shape, and surface features are contemplated. For example, a handle shape may optionally include surface depressions or grooves to correspond with and guide individual fingers of a user when gripping the handle. The handles with stems may be interchanged as desired to provide for variability in performing push-up exercises using apparatus 100. The use of different interchangeable handles assists in activating different muscle groups in the user's body, including different muscles in the hands, arms, upper body and core. For example, each different interchangeable handle may activate different muscles groups while performing the push-up exercise. Optionally, interchangeable handles may have different length stems that provide even greater ranges of height adjustment. In yet other optional embodiments, the handles may be configured to rotate with respect to the base portion 101. For example, the stems may rotate or spin 360 degrees within the base portion 101 to provide additional variation in performing the push-up exercise. According to other embodiments, the stems may rotate less than 360 degrees, such as 90 degrees, 180 degrees, 270 degrees, or other ranges included therein.

In preferred embodiments, the apparatus 100 provides for height adjustability to allow for variations in performing the push-up exercise. As illustrated in FIG. 3 for example, handle 102 includes a cylindrical stem 112 which is configured to be slideably positioned within base structure 101 and locked in position at selected heights. As shown, handle stem 112 includes a series of notches 114 along the height of the stem 112 to allow for selective positioning of the handle 102 at various heights with respect to the base structure 101 which remains stationary. Notches 114 may be depressions, grooves, channels, dimples, or other indentations into the cross-section of the stem. Notches may be limited to particular locations around the stem or may extend around part or all of the circumference or perimeter of the stem. Notches may be aligned or in offset positions relative to each other in particular embodiments.

Figure 5:
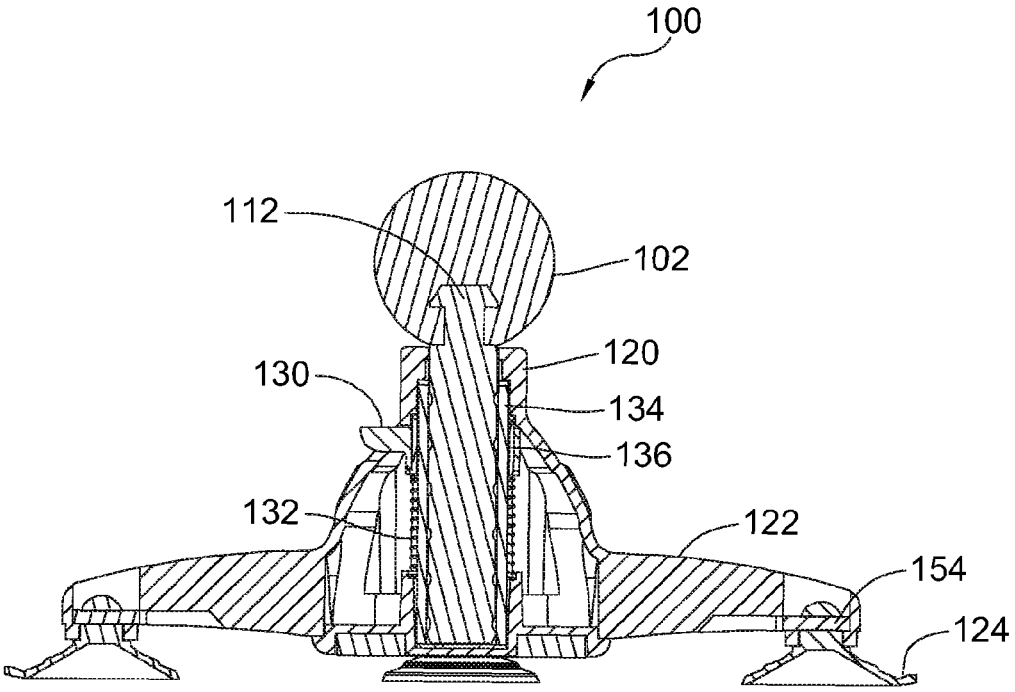
FIG. 5 is a side cross-sectional view of the adjustable push-up apparatus of FIG. 1.
Figure 6:
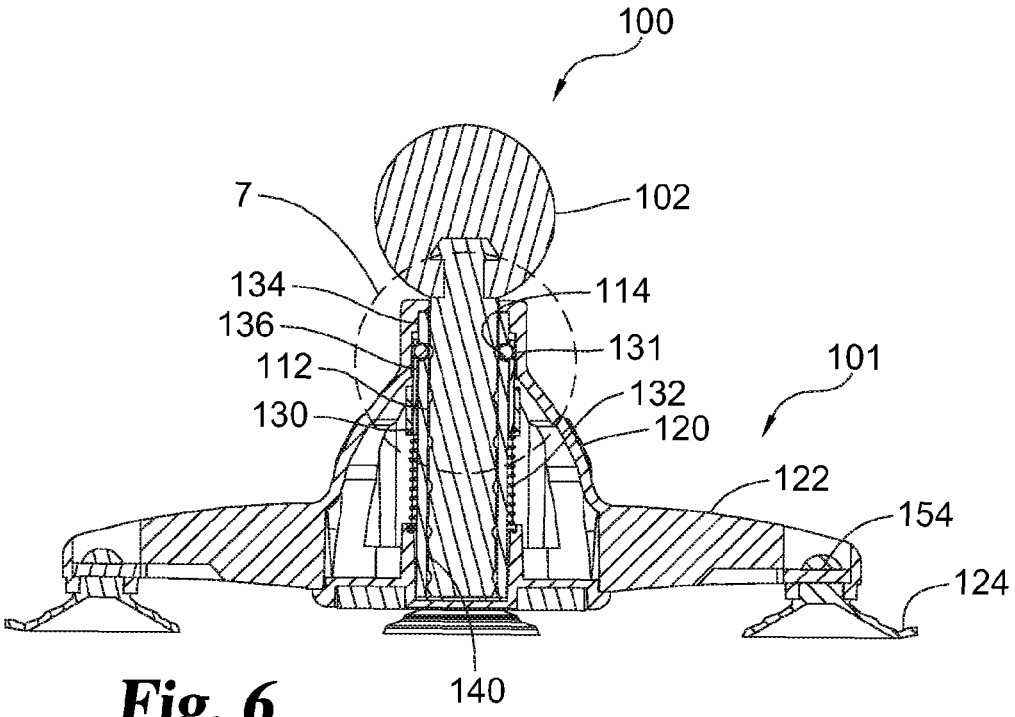
FIG. 6 is another side cross-sectional view of the adjustable push-up apparatus of FIG. 1.

In the particular illustrated embodiment shown in FIGS. 5-6, the push button release 130 operates in conjunction with a set of internal ball bearings 131 designed to allow for the selective engagement and height positioning of the handle 102 with respect to the base portion 101 (see FIG. 6). However, it should be appreciated that other appropriate selective engagement and height-adjustment mechanisms may be used as would occur to one of ordinary skill in the art. Additionally, it should be appreciated that the apparatus 100 may be adjusted to different heights within appropriate ranges.

Figure 7:
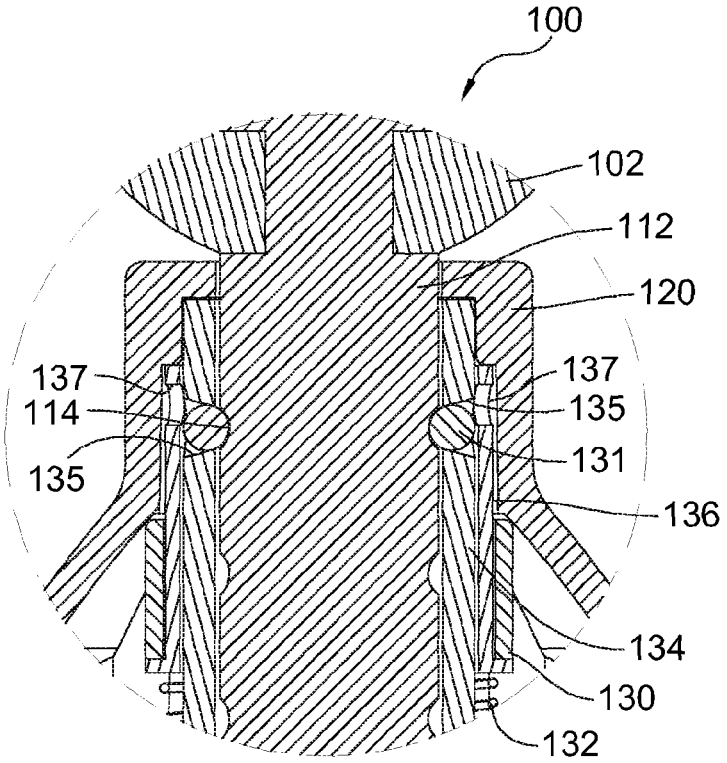
FIG. 7 is a close-up side cross-sectional view of a portion of the adjustable push-up apparatus of FIG. 1 corresponding to the encircled area of FIG. 6.

Referring to FIG. 6, the particular illustrated embodiment of the base structure 101 of apparatus 100 includes a spring 132, an inner tube 134 and an outer tube 136. The inner tube and outer tube may be coaxial and aligned in a vertical direction. The inner tube 134 has cut-away sections 135 and the outer tube 136 has recessed sections 137. The inner tube 134 defines a center hole 140 into which stem 112 is slideably received. As best illustrated in FIG. 7, at the locked position the ball bearings 131 reside in cut-away sections 135 and protrude at least partially into the set of aligned notches 114 to engage the handle 102 in a locking fashion. The spring 132 exerts an upward force on the outer tube 136, such that the recessed sections 137 are not aligned with the cut-away sections 135 and the outer tube 136 urges the ball bearings into the notches 114, thereby locking the handle 102 into position.

Figure 8:
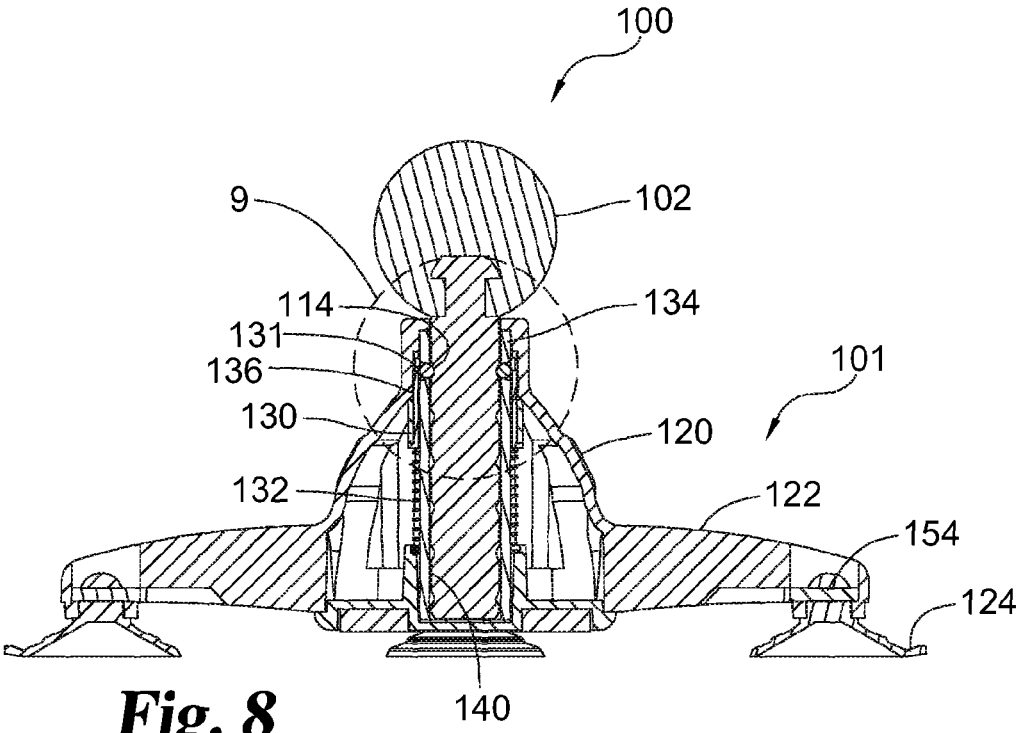
FIG. 8 is another side cross-sectional view of the adjustable push-up apparatus of FIG. 1.
Figure 9:
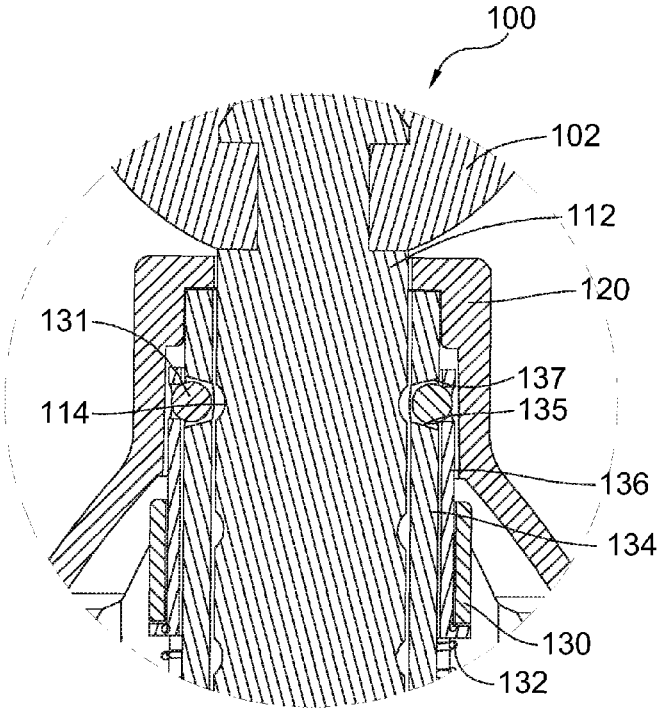
FIG. 9 is another close-up side cross-sectional view of a portion of the adjustable push-up apparatus of FIG. 1 corresponding to the encircled area of FIG. 8.
Figure 10:
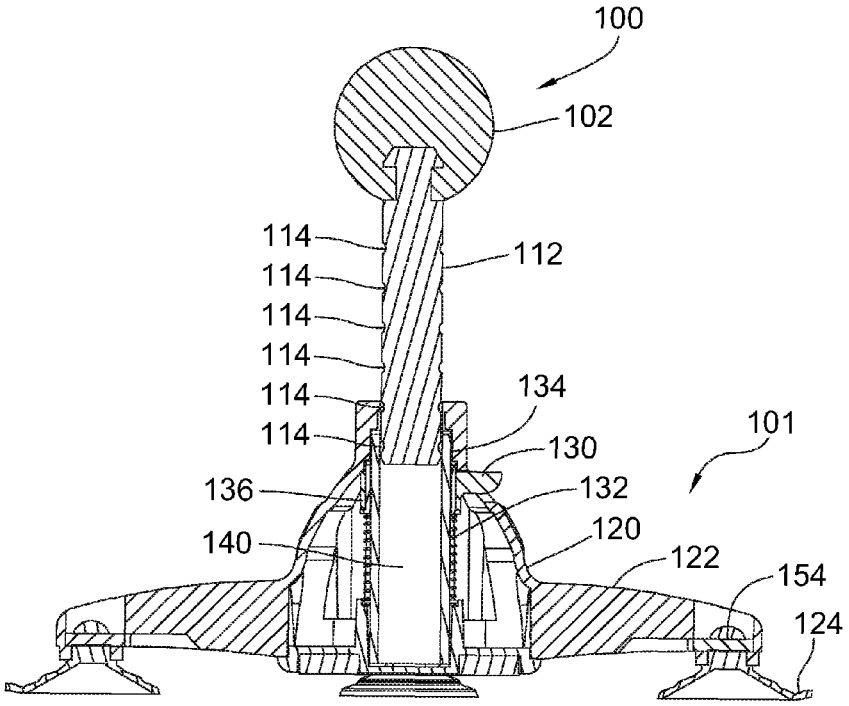
FIG. 10 is another side cross-sectional view of the adjustable push-up apparatus of FIG. 1.

When the device is in the open and unlocked position, the ball bearings 131 retract at least partially into the recessed sections 137 defined in outer tube 136, thereby allowing for sliding of the handle stem 112 within the center hole 140 as desired. To adjust the height of the device 100, a user may depress button 130 to unlock the device 100 and enable movement of the handle 102 with respect to the body structure 101. The button 130 may be pushed downward by a user, thereby causing the outer tube 136 to move downward against the biasing force of the spring 132. By pushing the button 130, the outer tube 136 is caused to move downward to a position where recessed areas 137 are aligned with cut-away sections 135. Upon such alignment, the ball bearings 131 will move outward or retract at least partially into the recessed sections 137 and out of the notches 114 in handle stem 112, as best illustrated in FIGS. 8 and 9. In this way, the handle 102 may be freely adjusted within hole 140 to allow for height-adjustment of the device. Although the illustrated locking and unlocking mechanism is an example using a push button mechanism, it should be appreciated that other appropriate mechanisms may be used.

When the handle 102 is adjusted to the desired height with respect to the base structure 101, the button 130 may be released, allowing the components to return to the locked position. Releasing the button 130 results in the spring 132 causing the outer tube 136 to move upward to a position where ball bearings 131 are urged into notches 114 and thus into locking engagement with the handle 102.

Device 100 can be manufactured and assembled from standard materials, such as plastic or metal based materials as examples. Additionally, some or all of the components forming the exterior of device 100 may include coatings, covers or skins made of suitable materials. Additionally, the handles may optionally include texturing, be manufactured from a gripping material, or include an outer covering designed to assist with gripping of the apparatus 100 by a user during performance of a push-up exercise.

Additionally, as mentioned above the figures provide non-limiting examples for the device 100. However, it should be appreciated that the device and its various components may be sized and configured differently as would occur to one of ordinary skill in the art. For example, the Figures illustrate round or cylindrical base members, stems, and tubes, yet other shapes such as square, rectangular, elliptical, parabolic, polygonal, or irregular cross-sections may be provided to various components without departing from the disclosure. Further, it is contemplated that the device may include fewer than all of the example illustrated components shown in the accompanying figures, and/or may include additional suitable and/or necessary components not presently illustrated as would occur to one of ordinary skill in the art.

While the disclosure has been illustrated and described in detail in the drawings and foregoing description, the same is to be considered as illustrative and not restrictive in character, it being understood that only the preferred embodiment has been shown and described and that all changes and modifications that come within the spirit of the disclosure are desired to be protected.

I claim:

1. An adjustable push-up apparatus, comprising:

a first handle including a grip portion and a stem portion provided with a series of engagement points; and a base including an exterior, an inner passage for receiving the stem portion, and a locking mechanism including a ball bearing;

wherein the locking mechanism is biased to a closed position wherein the ball bearing fits at least partially into a selected one of the series of engagement points to fix the vertical position of the stem portion within the inner passage, wherein the locking mechanism is configured to selectively disengage to an open position allowing the ball bearing to retract from the selected one of the series of engagement points and enable vertical movement of the first handle, and wherein the stem portion is rotatable relative to the base when the locking mechanism is in the closed position.

2. The apparatus of claim 1, comprising a second handle including a grip portion, wherein the second handle is interchangeable with the first handle when the locking mechanism is in the open position.

3. The apparatus of claim 1, comprising a button on the exterior of the base configured to disengage the locking mechanism.

4. The apparatus of claim 1, wherein a range of rotation of the stem portion relative to the base in the closed position is 360 degrees.

5. The apparatus of claim 1, wherein the series of engagement points are notches providing selective positioning of the first handle at various heights relative to the base.

6. The apparatus of claim 5, wherein the notches extend around an entire circumference of the stem portion.

7. The apparatus of claim 1, wherein the base includes an extending leg and a surface-engaging foot connected to the extending leg.

8. The apparatus of claim 7, wherein the surface-engaging foot includes a suction cup.

9. The apparatus of claim 7, wherein the surface-engaging foot is pivotally connected to the extending leg.

10. The apparatus of claim 1, wherein the base includes a plurality of extending legs symmetrically positioned around the base.

11. An adjustable push-up apparatus having a locking apparatus with an open position and a closed position, the locking apparatus comprising:

a latch member;

an inner tube defining a center hole that slideably receives a stem including an engagement point, the inner tube including a section for receiving at least a portion of the latch member;

an outer tube slideably coaxial with the inner tube and having a recessed portion;

wherein in the closed position, at least a portion of the latch member protrudes through the section and toward the engagement point, preventing the stem from sliding toward either end of the center hole, and the stem is rotatable relative to the inner tube; and wherein in the open position, the recessed portion aligns with the section and receives the latch member, allowing the latch member to retract from the engagement point.

12. The apparatus of claim 11, wherein the latch member is a ball bearing.

13. The apparatus of claim 11, comprising a biasing member exerting a force on the outer tube to bias the apparatus toward the closed position.

14. The apparatus of claim 11, comprising a button configured to shift the apparatus between the closed position and the open position.

15. The apparatus of claim 12, comprising:

a base housing the inner tube and outer tube and including a surface-engaging foot;

a first handle attached to the stem; and a second handle attached to a second stem including a second engagement point;

wherein in the open position the first handle and stem are replaceable with the second handle and second stem such that in the closed position the protrusion of the latch member into the second engagement point prevents the second stem from sliding toward either end of the center hole.

* * * * *